US010190380B2

(12) United States Patent
Trivedi et al.

(10) Patent No.: US 10,190,380 B2
(45) Date of Patent: Jan. 29, 2019

(54) METHOD FOR MONITORING A SEALING ELEMENT

(71) Applicant: GENERAL ELECTRIC COMPANY, Schenectady, NY (US)

(72) Inventors: Deepak Trivedi, Schenectady, NY (US); William Lyle Carbaugh, Humble, TX (US); Gregory Ronald Gillette, Houston, TX (US); Joseph Alan Incavo, The Woodlands, TX (US); Weina Ge, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 708 days.

(21) Appl. No.: 14/277,091

(22) Filed: May 14, 2014

(65) Prior Publication Data

US 2015/0330173 A1 Nov. 19, 2015

(51) Int. Cl.
*E21B 47/10* (2012.01)
*E21B 33/06* (2006.01)

(52) U.S. Cl.
CPC ..... *E21B 33/06* (2013.01); *E21B 47/1025* (2013.01)

(58) Field of Classification Search
CPC ..... E21B 33/06; E21B 47/1025
USPC ..... 73/152.29
See application file for complete search history.

(56) References Cited

U.S. PATENT DOCUMENTS 3,887,158 A 6/1975 Polk
4,579,314 A 4/1986 Schaeper et al.
4,614,148 A 9/1986 Bates
5,819,851 A 10/1998 Dallas
6,325,159 B1 * 12/2001 Peterman ..... E21B 21/001 166/350
7,647,980 B2 1/2010 Corre et al.
7,735,564 B2 6/2010 Guerrero
7,980,305 B2 7/2011 Judge et al.
8,413,716 B2 4/2013 Judge et al.
(Continued)

FOREIGN PATENT DOCUMENTS

WO 2013185227 A1 12/2013
WO GB 2524789 A * 10/2015 ..... E21B 44/00

OTHER PUBLICATIONS

PCT Search Report and Opinion issued in connection with corresponding Application No. PCT/US2015/29389 dated Sep. 22, 2015.

*Primary Examiner* — John Fitzgerald
*Assistant Examiner* — Rodney T Frank
(74) *Attorney, Agent, or Firm* — GE Global Patent Operation

(57) ABSTRACT

Embodiments of a method for monitoring an annular packer are provided herein. In some embodiments, a method for monitoring a sealing element of a blowout preventer may include providing a fluid to a chamber disposed within a blowout preventer to actuate a piston disposed within the chamber, wherein the actuation of the piston causes a reduction of an inner diameter of a sealing element; measuring one or more parameters of the fluid via a sensor; receiving data relating to the one or more parameters from the sensor; determining a stiffness of the sealing element utilizing the data relating to the one or more parameters; and determining an amount of degradation of the sealing element by comparing the determined stiffness of the sealing element to a known data profile.

20 Claims, 2 Drawing Sheets

(56) References Cited

U.S. PATENT DOCUMENTS

| | | | | |
|---|---|---|---|---|
| 8,540,017 | B2 | 9/2013 | Ensley et al. | |
| 2005/0192727 | A1* | 9/2005 | Shostak | B60C 11/24 701/37 |
| 2006/0037782 | A1 | 2/2006 | Martin-Marshall | |
| 2009/0152006 | A1* | 6/2009 | Leduc | E21B 21/08 175/48 |
| 2010/0170673 | A1 | 7/2010 | Krueger et al. | |
| 2012/0197527 | A1 | 8/2012 | McKay et al. | |
| 2015/0167424 | A1* | 6/2015 | Richards | E21B 33/134 166/386 |
| 2015/0285054 | A1* | 10/2015 | Johnson | E21B 44/00 73/152.48 |

* cited by examiner

METHOD FOR MONITORING A SEALING ELEMENT

BACKGROUND

The subject matter disclosed herein generally relates to blowout preventers, and more specifically, to monitoring components of blowout preventers.

Conventional blowout preventers (BOPs) include one or more sealing elements (e.g., an annular packer, or packing unit) configured to, for example, create a seal about a well tool (e.g., drillpipe) and/or completely seal a wellbore when actuated. Such sealing elements are typically fabricated from a process compatible elastomeric material. However, such elastomeric materials are subject to degradation due to, for example, loss of material, change in properties due to ageing (e.g., elasticity, stiffness, or the like), thereby having a limited useful life. Such degradation could lead to catastrophic failure of the blowout preventer.

As such, frequent maintenance and inspection and/or replacement of the sealing elements occur on a predetermined time based schedule. However, the inventors have observed that such time based schedules are inaccurate with respect to the useful life of the sealing element, thereby possibly resulting in missed detection of a potentially premature failure of a sealing element, or alternatively, a premature replacement of a functional sealing element, resulting in higher cost and waste.

Therefore, the inventors have provided an improved method for monitoring a sealing element.

SUMMARY

Embodiments of a method for monitoring a sealing element are provided herein.

In some embodiments, a method for monitoring a sealing element of a blowout preventer may include providing a fluid to a chamber disposed within a blowout preventer to actuate a piston disposed within the chamber, wherein the actuation of the piston causes a reduction of an inner diameter of a sealing element; measuring one or more parameters of the fluid via a sensor; receiving data relating to the one or more parameters from the sensor; determining a stiffness of the sealing element utilizing the data relating to the one or more parameters; and determining an amount of degradation of the sealing element by comparing the determined stiffness of the sealing element to a known data profile.

In some embodiments, a computer readable medium, having instructions stored thereon which, when executed, causes a method for monitoring a sealing element of a blowout preventer to be performed, wherein the method may include providing a fluid to a chamber disposed within a blowout preventer to actuate a piston disposed within the chamber, wherein the actuation of the piston causes a reduction of an inner diameter of a sealing element; measuring one or more parameters of the fluid via a sensor; receiving data relating to the one or more parameters from the sensor; determining a stiffness of the sealing element utilizing the data relating to the one or more parameters; and determining an amount of degradation of the sealing element by comparing the determined stiffness of the sealing element to a known data profile.

The foregoing and other features of embodiments of the present invention will be further understood with reference to the drawings and detailed description.

DESCRIPTION OF THE FIGURES

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of the invention and are therefore not to be considered limiting in scope, for the invention may admit to other equally effective embodiments.

To facilitate understanding, identical reference numbers have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of a method for monitoring sealing elements are disclosed herein. The inventive method advantageously facilitates monitoring components (e.g., a sealing element, annular packing unit, or the like) of a blowout preventer, thereby improving drilling operational availability and reliability, maintenance agility and responsiveness and reducing maintenance cost.

Figure 1:
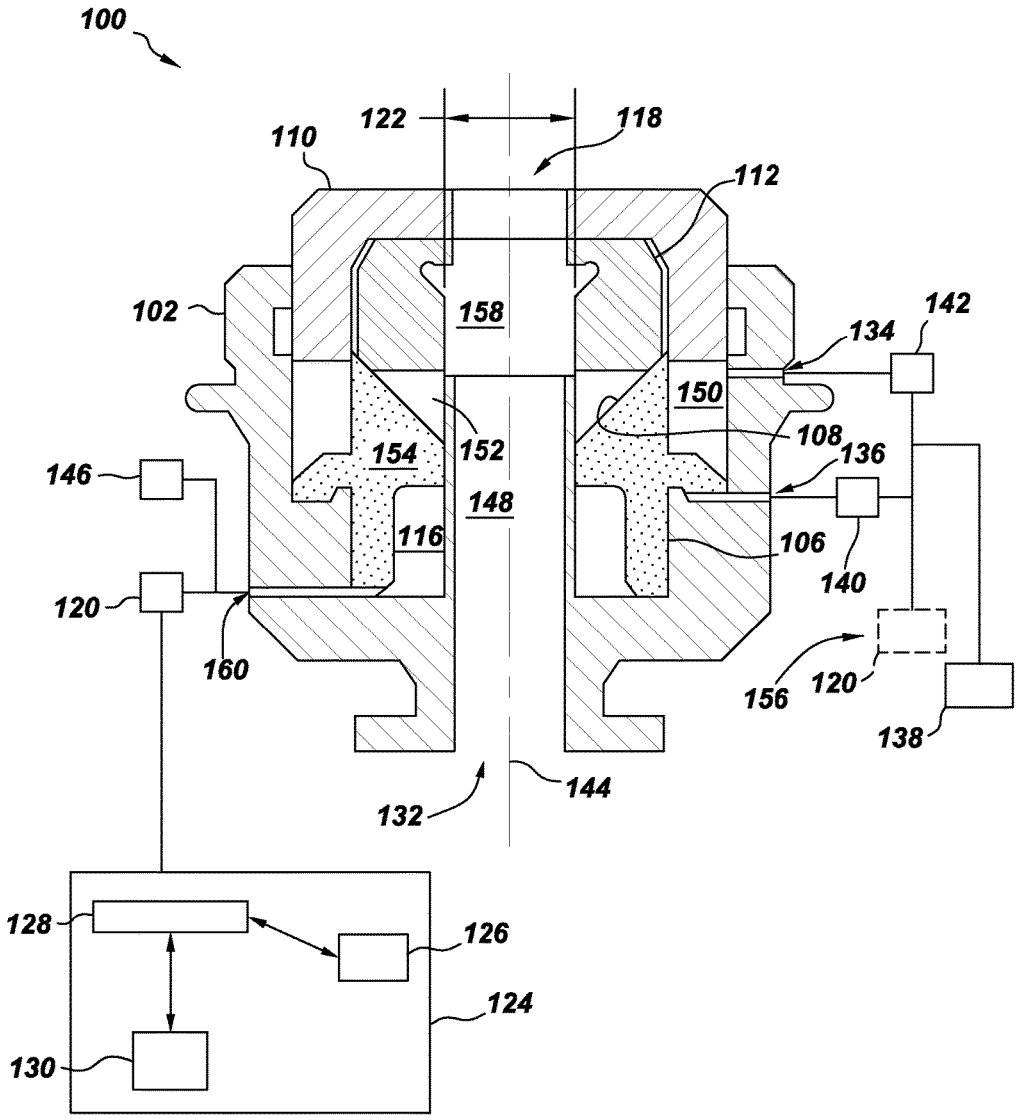
FIG. 1 is a cross sectional view of a portion of an exemplary blowout preventer suitable for use with the inventive method in accordance with some embodiments of the present invention.

FIG. 1 is a cross sectional view of a portion of an exemplary blowout preventer (annular packing unit or packing unit) 100 suitable for use with the inventive method in accordance with some embodiments of the present invention. In some embodiments, the annular packing unit 100 generally includes a housing 102, removable head 110, sealing element 112 and piston 106.

The housing 102 comprises an inner cavity 148 that defines at least a portion of a wellbore 132. The inner cavity 148/wellbore 132 may have any dimensions suitable to facilitate a drilling and/or pumping operation. For example, in some embodiments, the wellbore 132 may be sized to accommodate a drillpipe, well tool, or the like. In some embodiments, an annular channel 152 may be formed in a portion of the housing 102. When present, the channel 152 may be configured to accommodate the piston 106.

In some embodiments, the piston 106 generally comprises a body 154 having an angled face (wedge face) 108. In such embodiments, the angled face 108 may be configured to apply a force to the sealing element 112 when the piston 106 is actuated, for example such as described below in the exemplary operation of the annular packing unit 100. In some embodiments, when disposed in the channel 152, the piston 106 may isolate one portion of the channel 152 from another portion of the channel 152 to form a first chamber 150 and second chamber 116 within the channel 152.

In some embodiments, one or more ports (a first port 134 and second port 136 shown) may be disposed through a portion of the housing 102 to fluidly couple a first fluid source 138 to the first chamber 150. When present, the one or more ports allow a fluid from the first fluid source 138 to be provided either above (via the first port 134) or below (via the second port 136) the piston 106 to facilitate actuating the piston 106 in a direction parallel to a central axis 144 of the packing unit 100. In some embodiments, one or more valves (first valve 140 and second valve 142 shown) may be disposed between the fluid source 135 and each of the first port 134 and second port 136 to allow a fluid from the fluid source 138 to be selectively provided to the one or more ports.

The first fluid source 138 may be configured to provide any fluid suitable to facilitate actuating the piston 106 as described herein. For example, in some embodiments, the first fluid source 138 may be configured to provide a non-compressible or hydraulic fluid, for example, water, oils, alcohols, esters, silicones, or the like. As used herein, the term "non-compressible" means a fluid having a bulk modulus of about 100,000 psi or greater. However, it is to be noted that a compressible fluid with a comparatively lower bulk modulus (e.g., air, nitrogen, or the like) may also be utilized and may be dependent on the particular application.

In some embodiments, one or more sensors (one sensor 120 shown) may be fluidly coupled to a portion of the channel 152 to facilitate monitoring one or more properties (e.g., flow rate, pressure, or the like) of a fluid (e.g., the non-compressible or hydraulic fluid described above) within the channel 152. By monitoring the one or more properties, the inventors have observed that a displacement of the piston 106 or a force of the piston 106 as it is actuated may be estimated or determined. The sensor 120 may be any type of sensor suitable to monitor one or more properties (e.g., flow rate, pressure, load, or the like) of the fluid disposed within the channel 152. For example, in some embodiments, the sensor 120 may be a flow meter, pressure transducer, or the like.

The sensor 120 may be coupled to the channel 152 in any location suitable to monitor the one or more properties. For example, in some embodiments, the sensor 120 may be fluidly coupled to the second chamber 116 via a third port 160 to monitor the one or more properties of the fluid disposed in the second chamber 116 as the piston 106 is actuated. In such embodiments, a second fluid source 146 may be coupled to the third port 160 to provide the fluid or allow the exhausting of the fluid from the second chamber 116 as the piston 106 is actuated. Alternatively, or in combination, the sensor may be coupled to the first port 134 and/or the second port 136 to monitor the one or more properties of the fluid disposed in the first chamber 150, for example, such as shown in phantom at 156.

In some embodiments, a controller 124 may be coupled to the sensor 120 to facilitate performing the methods as described herein. The controller 124 may be one of any form of general-purpose computer processor that can be used in an industrial setting for controlling various chambers and sub-processors. The memory 126, or computer-readable medium, of the CPU 128 may be one or more of readily available memory such as random access memory (RAM), read only memory (ROM), floppy disk, hard disk, or any other form of digital storage, local or remote. The support circuits 130 are coupled to the CPU 128 for supporting the processor in a conventional manner. These circuits include cache, power supplies, clock circuits, input/output circuitry and subsystems, and the like. The inventive method described herein is generally stored in the memory 126 as a software routine. The software routine may also be stored and/or executed by a second CPU (not shown) that is remotely located from the hardware being controlled by the CPU 128.

The removable head 110 is removably coupled to the housing 102 and functions to limit or prevent vertical movement of the sealing element 112 during actuation of the piston 106. In some embodiments, the removable head 110 includes a through hole 118 formed through the removable head 110 to further define the well bore 132.

The sealing element 112 may be any type of sealing element suitable to, for example, create a seal about a well tool (e.g., drillpipe) and/or completely seal a wellbore when actuated, for example, such as a packer element, annular packer, or the like. The sealing element 112 may comprise any shape suitable to provide the aforementioned seal in a desired application and may be dependent on the size and/or shape of other components of the packing unit 100. For example, in some embodiments, the sealing element 112 may be substantially ring shaped, having a bore 158 that is generally concentric with the wellbore 132 defined by the housing 102 and/or removable head 110, such as shown in FIG. 1.

The sealing element 112 may be at least partially fabricated from any elastomeric material that is compatible with process conditions of a desired application. For example, in some embodiments, the sealing element 112 may be fabricated from a polymer, such as a rubber compound, silicone or the like. In embodiments where the sealing element 112 is fabricated from a rubber compound, the compound may be based on any suitable rubber compound, for example, such as a compound based on nitrile butadiene rubber, hydrogenated butadiene rubber, natural rubber, butyl rubber, fluorocarbon rubber, perfluorinated rubber, silicone rubber, polyurethane rubber, styrene butadiene rubber, butadiene rubber, polychloroprene rubber, epichlorohydrin rubber, silicone rubber, ethylenpropylene diene rubber, polyacrylate rubber, or the like. The rubber compound may be selected at least in part based on properties that may be suitable to accommodate a particular application. In some embodiments, the sealing element 112 may further include other components to facilitate operation of the sealing element 112, for example, metal inserts (not shown) or the like.

In an exemplary operation of the packing unit 100 actuation of the piston 106, and therefore a reduction or expansion of the inner diameter 122 of the sealing element 112, may be facilitated by provision of the non-compressible or hydraulic fluid either above or below the piston 106 to facilitate actuating the piston 106. For example, to raise the piston 106, the non-compressible or hydraulic fluid may be provided from the first fluid source 138 to an area beneath the piston 106 within the first chamber 150 via the second port 136. The provision of fluid causes the piston to move towards the removable head 110 in a plane parallel to the central axis 144 of the packing unit 100. Such movement causes the face 108 of the piston 106 to apply a force to the sealing element 112, thereby causing a compression of the sealing element 112 inwards towards the central axis 144 of the packing unit 100, thereby reducing the inner diameter 122 of the sealing element 112. The inner diameter 122 may be reduced in such a manner by any amount suitable to create a seal about a well tool (e.g., drillpipe) and/or completely seal the wellbore 132.

In another example, the non-compressible or hydraulic fluid may be provided from the first fluid source 138 to an area above the piston 106 within the first chamber 150 via the first port 134. The provision of fluid causes the piston to move away from the removable head 110 in the plane parallel to the central axis 144 of the packing unit 100. Such movement causes the face 108 of the piston 106 to reduce a force to the sealing element 112, thereby causing an expansion of the sealing element 112 away from the central axis 144 of the packing unit 100, thereby increasing the inner diameter 122 of the sealing element 112.

In either variation of the operation of the packing unit 100 as described above, the sensor 120 may monitor a flow rate or pressure of the fluid within the channel 152 before, during or after actuation of the piston 106.

The inventors have observed that the elastomeric material (e.g., elastomeric materials described above) utilized to fabricate sealing elements of blowout preventers (e.g., the sealing element 112 described above) are subject to degradation due to, for example, loss of material, change in properties due to ageing (e.g., elasticity, stiffness, or the like), thereby having a limited useful life. Such degradation could lead to catastrophic failure of the blowout preventer. The inventors have further observed that, because no current mechanism exists to monitor the health of the sealing elements, frequent maintenance and inspection and/or replacement of the sealing elements occur on a predetermined time based schedule. However, the such time based schedules are inaccurate with respect to predicting or recognizing the useful remaining life of the sealing element, thereby possibly resulting in missed detection of a potentially premature failure of a sealing element, or alternatively, premature replacement of a functional sealing element, resulting in higher cost and waste. Moreover, unnecessary maintenance and inspection of the sealing elements causes frequent downtime, thereby reducing efficiency of drilling operations.

Figure 2:
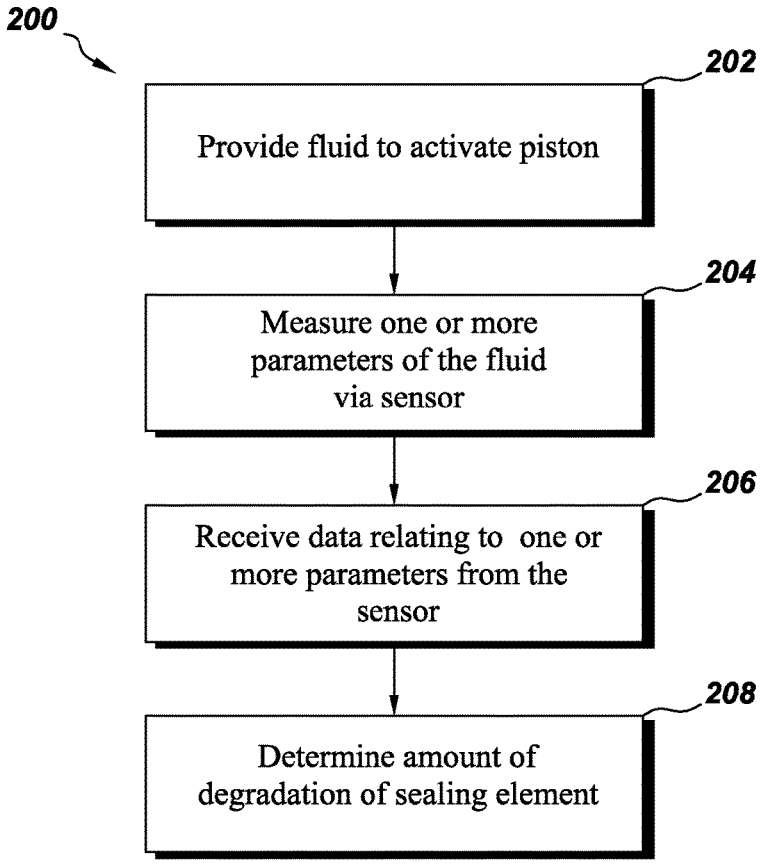
FIG. 2 depicts a method for monitoring a sealing element in accordance with some embodiments of the present invention.

Accordingly, the inventors have provided a method for monitoring a sealing element. Referring to FIG. 2, in some embodiments, the method 200 may begin at 202 where a fluid is provided to a chamber disposed within a blowout preventer to actuate a piston disposed within the chamber. The blowout preventer may be any type of blowout preventer having a piston capable of being actuated and configured to facilitate at least a partial closure or sealing of a wellbore, for example, such as the packing unit 100 described above. In some embodiments, actuating the piston causes a reduction of an inner diameter of a sealing element, for example, such as the reduction of the inner diameter 122 of the sealing element 112 in the exemplary operation of the packing unit 100 as described above.

Next, at 204, one or more parameters of the fluid may be measured via a sensor. The one or more parameters may be measured at any time with respect to the actuation of the piston, for example, such as before, during or after the actuation of the piston at 202. Moreover, any number of measurements may be taken that is suitable to facilitate the determination of an amount of degradation of the sealing element, as described below.

The one or more parameters may reflect any properties of the fluid suitable to provide an indication of an amount of degradation of the sealing element, for example, such as described below. For example, in some embodiments the one or more parameters may be at least one of a pressure of the fluid within the chamber, flow rate of the fluid as it flows into the chamber, or volume of the fluid in the chamber.

The sensor may be any type of sensor suitable to measure the one or more parameters, for example, such as a flow meter, pressure transducer, load cell, combinations thereof, or the like. The sensor may be positioned in any manner suitable to measure the one or more parameters. For example, in some embodiments, the sensor may be fluidly coupled to the chamber such as the sensor 120 of the packing unit 100 described above.

Next, at 206, the data relating to the one or more parameters may be received. The data may be received by any suitable device suitable to allow the data to be monitored to facilitate the determination of an amount of degradation of the sealing element, such as described below. For example, in some embodiments, the data may be received by a computer or controller, such as the controller 124 described above.

Next, at 208, an amount of degradation of the sealing element may be determined utilizing the data relating to the one or more parameters.

The data may be utilized in any manner suitable to facilitate determining the amount of degradation of the sealing element. For example, the inventors have observed that the aforementioned parameters (e.g., flow rate and pressure of the fluid) are indicative of a displacement of the piston or a force of the piston as the piston is actuated. For example, a flow rate of the fluid may be utilized to determine the piston displacement as a function of time as the piston is actuated. Such a relationship between the flow rate and piston displacement may be illustrated by the following:

$$d(t) = \frac{1}{A}\int_0^t \dot{q}(t)\,dt$$

where d is the piston displacement, t is the time, A is the piston area, and $\dot{q}$ is the flow rate measured by the flow meter. In addition, pressure of the fluid within the chamber may be utilized to determine the piston force as the piston is actuated. Such a relationship between the pressure of the fluid and the piston force may be illustrated by the following:

$$F_p=(P_c-P_o)A$$

where A is the piston area, $P_c$ is the closing pressure and $P_o$ is the opening pressure.

The inventors have observed that both the piston displacement and piston force may be utilized to determine an amount of degradation of the sealing element. For example, a slope of the piston force vs. piston displacement curve is indicative of a measure of stiffness of the sealing element. Thus, a change in the slope of the piston force vs. displacement curve indicates a change in the stiffness of the sealing element, and therefore, provides information relating to a degradation of the sealing element. As such, by measuring the one or more parameters of the fluid, the inventors have observed that an amount of degradation of the sealing element may be determined.

The inventors have observed that utilizing the stiffness of the sealing element and/or changes thereof as described herein advantageously provides a more accurate indication of an amount of degradation of the sealing element as compared to, for example, monitoring and comparing single measurement parameters (e.g., flow rate, pressure, or the like).

In some embodiments, the amount of degradation of the sealing element may be determined by comparing the measured parameters or calculated data (e.g., piston force, piston displacement, stiffness as described above) to other sealing element profiles obtained from previously performed measurements of same or similar sealing elements and/or simulations/tests previously performed on the sealing element materials. By doing such a comparison, the inventors have observed that the presence of damage or one or more properties of the damage may be determined.

For example, a comparison of an average measured stiffness of the sealing element may be compared to a benchmark obtained from a previously measured sealing element to provide a qualitative indication that damage may be present within the sealing element (e.g., "damage detection"). In another example, a position of damage present within the sealing element may be obtained by tracking a significant portion of a measured piston force vs piston displacement curve and locating where in the piston actuation cycle the measured piston force vs piston displacement curve significantly deviates from a previously measured piston force vs piston displacement curve (e.g., "damage assessment"). In another example, a type of damage present in the sealing element may be obtained by comparing measured stiffness curve of the sealing element to a previously measured stiffness curve of a same or similarly damaged sealing element (e.g., "damage classification"). In another example, a remaining useful life of the sealing element may be determined by comparing the above described damage assessment to a damage assessment of a previously failed sealing element (e.g., "damage prognosis" or "life estimation").

In some embodiments, the one or more previously performed simulations/test may be performed to determine any mechanisms of failure. For example, in some embodiments the one or more previously performed simulations/test may be performed to determine one or more of loss of rubber due to tearing (e.g., up to 100% loss), chemical degradation of the sealing element materials (e.g., exposing the sealing element materials to one or more chemicals at varying concentration and/or time to determine an amount of degradation from no degradation to complete degradation), debonding of metal inserts disposed within the sealing element (up to complete debonding of the metal inserts from the sealing element), deformation of plastic inserts disposed within the sealing element (e.g., deformation cause by up to about 50% plastic strain), material wear (e.g., failure resulting from no wear up to wear of about 10 inches or greater), cracking of material, material creep, or the like. Alternatively, or in combination, the simulations may include one or more tests to determine one or more of the following material properties: uniaxial tension, uniaxial compression, shear, biaxial tension, volumetric compression, stress relaxation, elongation. Any of the above listed simulations may be performed under varying temperature and/or pressure conditions, for example, such as temperatures of about −50 F to about 500 F, and pressures of about 0 psi to 25000 psi.

In some embodiments, at least one of the measured one or more parameters, data relating to the one or more parameters and the determined amount of degradation of the sealing element may be stored, thus facilitating a building of a library that may be used to determine an amount of degradation of subsequently utilized sealing elements. Such a library may be stored in any suitable medium, for example the computer readable medium of the controller 124 described above.

After the data is monitored at 208, the method 200 generally ends and a decision to perform maintenance and/or replace the sealing element may be made based on the determination of the amount of degradation of the sealing element at 208. For example, if the amount of degradation of the sealing element is of a magnitude that falls within a predetermined threshold of predictable failure, maintenance may be performed on the blowout preventer to replace the sealing element.

Thus, embodiments of a method for monitoring a sealing element have been provided. In at least one embodiment, the inventive method may advantageously improve drilling operational availability and reliability, improve maintenance agility and responsiveness and reduce maintenance cost of drilling equipment.

Ranges disclosed herein are inclusive and combinable (e.g., ranges of "about 0 psi to about 25,000 psi", is inclusive of the endpoints and all intermediate values of the ranges of "about 0 psi to about 25,000 psi," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "some embodiments", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for monitoring a sealing element of a blowout preventer, comprising:

providing a fluid to a chamber disposed within a blowout preventer to actuate a piston disposed within the chamber, wherein the actuation of the piston causes a change of an inner diameter of a sealing element, wherein the piston surrounds at least a portion of the wellbore;

measuring one or more parameters of the fluid via a sensor;

receiving data relating to the one or more parameters of the fluid from the sensor;

determining a stiffness of the sealing element utilizing the data relating to the one or more parameters of the fluid; and determining an amount of degradation of the sealing element by comparing the determined stiffness of the sealing element to at least one historical element profile.

2. The method of claim 1, wherein the sensor is at least one of a flow meter or a pressure transducer.

3. The method of claim 1, wherein measuring the one or more parameters comprises:

measuring at least one of a pressure of the fluid provided to the chamber, a flow rate of the fluid provided to the chamber, or a volume of the fluid provided to the chamber, wherein the chamber is not in fluid communication with the wellbore.

4. The method of claim 3, wherein determining an amount of degradation of the sealing element further comprises:

determining a displacement of the piston utilizing the measured flow rate of the fluid provided to the chamber;

determining a force of the piston utilizing the measured pressure of the fluid provided to the chamber; and determining the stiffness of the sealing element utilizing the displacement of the piston and the force of the piston.

5. The method of claim 1, wherein the at least one historical element profile comprises one or more stiffness measurements or analytical simulations of another sealing element.

6. The method of claim 1, wherein the one or more parameters are measured while the piston is actuated.

7. The method of claim 1, wherein the one or more parameters are measured after the piston is actuated from a first position to a second position.

8. The method of claim 1, wherein the sealing element is an annular packer.

9. The method of claim 1, wherein the at least one historical element profile comprises a data profile obtained from one or more material property tests performed on materials utilized to fabricate the sealing element.

10. The method of claim 1, wherein the at least one historical element profile is obtained from a finite element analysis performed on a model of the sealing element.

11. A computer readable medium, having instructions stored thereon which, when executed, causing method for monitoring a sealing element of a blowout preventer to be performed, the method comprising:

providing a fluid to a chamber disposed within a blowout preventer to actuate a piston disposed within the chamber, wherein the actuation of the piston causes a change of an inner diameter of a sealing element, wherein the piston surrounds at least a portion of the wellbore;

measuring one or more parameters of the fluid via a sensor;

receiving data relating to the one or more parameters of the fluid from the sensor;

determining a stiffness of the sealing element utilizing the data relating to the one or more parameters of the fluid; and determining an amount of degradation of the sealing element by comparing the determined stiffness of the sealing element to at least one historical element profile.

12. The computer readable medium of claim 11, wherein the sensor is at least one of a flow meter or a pressure transducer.

13. The computer readable medium of claim 11, wherein measuring the one or more parameters comprises:

measuring at least one of a pressure of the fluid provided to the chamber, a flow rate of the fluid provided to the chamber, or a volume of the fluid provided to the chamber, wherein the chamber is not in fluid communication with the wellbore.

14. The computer readable medium of claim 13, wherein determining an amount of degradation of the sealing element comprises:

determining a displacement of the piston utilizing the measured flow rate of the fluid provided to the chamber;

determining a force of the piston utilizing the measured pressure of the fluid provided to the chamber; and determining a stiffness of the sealing element utilizing the displacement of the piston and the force of the piston.

15. The computer readable medium of claim 14, wherein the at least one historical element profile comprises one or more stiffness measurements or simulations of another sealing element.

16. The computer readable medium of claim 11, wherein the one or more parameters are measured while the piston is actuated.

17. The computer readable medium of claim 11, wherein the one or more parameters are measured after the piston is actuated from a first position to a second position.

18. The computer readable medium of claim 11, wherein the at least one historical element profile is obtained from a finite element analysis performed on a model of the sealing element.

19. The computer readable medium of claim 11, wherein the sealing element is an annular packer.

20. The computer readable medium of claim 11, wherein the at least one historical element profile comprises a data profile obtained from one or more material property tests performed on materials utilized to fabricate the sealing element and/or from a finite element analysis performed on a model of the sealing element.

* * * * *